US011013648B2

(12) United States Patent
Misztela et al.

(10) Patent No.: US 11,013,648 B2
(45) Date of Patent: May 25, 2021

(54) WHEELCHAIR

(71) Applicant: MBL Poland Sp. z o.o, Piotrków Trybunalski (PL)

(72) Inventors: Przemyslaw Misztela, Piotrkow Trybunalski (PL); Sebastian Zawalski, Amelin (PL); Adam Szymczak, Uniejów (PL); Bichel Mogens Lauritsen, Piotrków Trybunalski (PL)

(73) Assignee: MBL Poland Sp. z o.o., Piotrkow Trybunalski (PL)

( * ) Notice: Subject to any disclaimer, the term of this patent is extended or adjusted under 35 U.S.C. 154(b) by 0 days.

(21) Appl. No.: 16/994,546

(22) Filed: Aug. 14, 2020

(65) Prior Publication Data

US 2021/0077324 A1 Mar. 18, 2021

(30) Foreign Application Priority Data

Sep. 17, 2019 (EP) ..... 19197713

(51) Int. Cl.
*A61G 5/10* (2006.01)

(52) U.S. Cl.
CPC ..... *A61G 5/1078* (2016.11); *A61G 5/1056* (2013.01); *A61G 5/1081* (2016.11)

(58) Field of Classification Search
CPC .. A61G 5/1043; A61G 5/1045; A61G 5/1056; A61G 5/1059; A61G 5/1064; A61G 5/107; A61G 5/1075; A61G 5/1078; A61G 5/1081; A61G 5/1091; Y10S 297/04
USPC ..... 297/DIG. 4
See application file for complete search history.

(56) References Cited

U.S. PATENT DOCUMENTS 4,385,769 A * 5/1983 Molino ..... A61G 5/00 128/845
4,641,848 A * 2/1987 Ayers ..... A61G 5/1081 280/250.1
4,966,379 A * 10/1990 Mulholland ..... A61G 5/00 280/242.1
5,102,195 A * 4/1992 Axelson ..... A61G 5/1043 297/440.2
5,292,144 A * 3/1994 Sosnoff ..... A61G 5/006 280/304.1

(Continued)

FOREIGN PATENT DOCUMENTS

CN 108836658 A 11/2018
EP 1226803 A1 7/2002

*Primary Examiner* — Tony H Winner
*Assistant Examiner* — Maurice L Williams
(74) *Attorney, Agent, or Firm* — Andrzej Malarz, Esq.

(57) ABSTRACT

A wheelchair comprising a support frame (200), a seat frame (210), which is connected movingly in its front part to the support frame (200), and is connected in its rear part to the support frame (200) via a spring shock absorbing mechanism in the form of a torsion beam (105) connected to the rear axle (101) of the wheelchair, via at least one connecting element (104) allowing for immobilization of the connection between the torsion beam (105) and the rear axle (101), wherein at least one end of the torsion beam (105) is fixedly connected to the lever (110) which is pivotally connected to the connector (120) connected to the rear part of the seat frame (210), furthermore, the ends of the torsion beam are pivotally supported by the slide sleeves (103) located in the brackets (102) mounted on the rear axle (101).

11 Claims, 2 Drawing Sheets

(56) References Cited

U.S. PATENT DOCUMENTS

| | | | | |
|---|---|---|---|---|
| 5,540,297 | A * | 7/1996 | Meier | A61G 5/045 180/6.5 |
| 5,851,019 | A * | 12/1998 | Gill | A61G 5/10 280/286 |
| 5,904,398 | A | 5/1999 | Farricielli | |
| 6,161,856 | A * | 12/2000 | Peterson | A61G 5/1062 280/250.1 |
| 6,217,114 | B1 | 4/2001 | Sloot | |
| 6,217,116 | B1 | 4/2001 | Sloot | |
| 6,792,633 | B1 * | 9/2004 | Ito | A61G 5/006 5/618 |
| 7,011,362 | B1 * | 3/2006 | Huang | A47C 1/035 297/325 |
| 8,573,621 | B1 * | 11/2013 | Reynolds | B60G 11/18 280/124.166 |
| 8,985,618 | B2 * | 3/2015 | Perk | A61G 5/02 280/647 |
| 9,050,227 | B1 * | 6/2015 | Hargroder | A61G 5/1089 |
| 9,193,240 | B2 * | 11/2015 | Lin | A61G 5/04 |
| 2008/0067777 | A1 * | 3/2008 | Dauw | A61G 5/1078 280/250.1 |
| 2012/0013098 | A1 * | 1/2012 | Hart | A61G 5/06 280/250.1 |
| 2019/0021927 | A1 * | 1/2019 | Mackenzie | A61G 7/05 |

* cited by examiner

WHEELCHAIR

TECHNICAL FIELD

The subject of the invention is a wheelchair which provides shock absorption of the user's chair/seat relative to the ground on which the wheelchair moves. This improves the comfort of the wheelchair's user, which is recommended for various types of diseases and/or rehabilitation.

Solutions of this type currently available on the market are usually implemented using a compression or extension spring system.

PRIOR ART

The Chinese patent application CN108836658A discloses a shock-absorbing wheelchair structure which comprises a wheelchair frame, a seat, two scissor-type shock absorbing mechanisms, a pair of rear wheels, a front wheel shock absorbing mechanism, side plates, a boot, and shock absorber springs. The seat is mounted on the scissor-type shock absorbing mechanisms located oppositely on the wheelchair's frame. The scissors-type absorbing mechanism comprises a bracket, a slider, springs, and connecting rods. Two brackets are placed opposite each other, however one of the brackets is mounted on the wheelchair frame, while the other is mounted on the bottom of the seat. The springs are placed in the brackets along with the sliders. The middle parts of the two connecting rods (forming the scissor mechanism) are cross-connected by a pin shaft, and the ends of the connecting rods are pivotally connected to the sliders. Using the pair of scissor-type shock absorbing mechanisms is intended to absorb shocks occurring under the seat.

The U.S. Pat. No. 5,851,019A discloses a construction of a wheelchair having independent suspension. This wheelchair has a rear swing axle pivotally connected with the seat frame, while the spring shock absorber controls the relative movement between them. The front suspension is connected to the seat frame separately from the rear suspension and comprises a support bar with front wheels, and is connected pivotally with the seat frame using four connectors. The three shock absorbers working between the front of the seat and the floating bar allow for a controlled vertical movement of the floating bar. The application U.S. Pat. No. 5,851,019A also discloses a wheelchair in which the rear wheels are connected by a separate swing arm connected pivotally with the seat frame at the front, and each swing arm also connected to the rear part of the seat frame using control arms and a spring shock absorber. The structure of the wheelchair, as disclosed in U.S. Pat. No. 5,851,019A, ensures the stability of the wheelchair which is convenient to use and able to go move on high steps and uneven surfaces without causing discomfort to the user.

There is also a wheelchair which provides full seat shock absorption achieved via a gas/oil shock absorber which is centrally located and which allows for the rigidity of the frame to be adjusted.

Additionally, there are also construction solutions in which shock absorption is provided via vibration absorption systems integrated with the wheels such as Softwheel or Loopwheels.

The solutions described above comprising systems with springs or a spring do not allow for smooth regulation of the system rigidity because it depends on the thread pitch. They may also fail due to the possible spring breakage during the utilization of the wheelchair thus affecting the user's safety.

On the other hand, solutions which enable smooth regulation of rigidity require the use of expensive and/or complex systems which may at times be prone to being damaged causing costly repairs.

THE ESSENCE OF THE INVENTION

The object of the invention is to develop a simple and reliable wheelchair design which will provide the user with satisfactory seat shock absorption during the use of the wheelchair.

The essence of the invention is a wheelchair comprising a support frame and a seat frame which is movingly connected in its front part to the support frame, and in the rear part it is connected with the support frame by a shock absorbing mechanism, characterized in that the shock absorbing mechanism is in the form of a torsion beam connected to the rear axle of the wheelchair via at least one connecting element which allows for immobilization of the connection between the torsion beam and the rear axle, where at least one end of the torsion beam is fixedly connected to the lever which is pivotally connected to a connector connected to the rear part of the seat frame, furthermore, the ends of the torsion beam are pivotally supported by slide sleeves located in the brackets mounted on the rear axle.

In the wheelchair according to the invention, the use of the absorption mechanism equipped with a torsion beam connected to the rear axle via at least one connecting element which allows for immobilization of the connection between the torsion beam and the rear axle ensures shock absorption of the seat relative to the surface on which the wheelchair moves. This improves the comfort of the wheelchair user. As the wheelchair moves, the seat moves with the user relative to the surface and the main frame of the wheelchair, and then returns to its original position.

The solution according to the invention allows for controlling the frame rigidity by changing the characteristics of the torsion beam activity—its tension through the proper positioning of at least one element connecting the torsion beam with the rear axle of the wheelchair, preferably clamps, which in effect allows the mechanism characteristics to better adapt to the requirements of the wheelchair user (e.g. permanent tilt of the user to one of the wheelchair sides).

If the case of using two elements which allow for immobilization of the connection between the torsion beam and the rear axle, it is possible to independently control the rigidity of each side of the wheelchair.

Fixing one or two connecting elements which allow for immobilization of the connection between the torsion beam and the rear axle in the center of the torsion beam (maximum symmetrical slide when two connectors are used) releases each side of the torsion beam, and consequently the greatest symmetrical shock absorption). Conversely, the maximum symmetrical separation of the clamps causes blockage of the system and maximum suspension rigidity.

Any symmetrical intermediate clamp settings, going from the inside to the outside, allow for stiffening the shock absorbing mechanism from the most flexible to the stiffest.

The maximum displacement of one connecting element or two connecting elements, depending on the embodiment, in one direction or the other, causes stiffening of that side of the mechanism and a simultaneous release of the other side.

Any other asymmetrical settings of one connecting element or two connecting elements separately or in pair allow for obtaining various level of rigidity of each side of the mechanism which translates into changes in rigidity of the individual sides of the wheelchair.

Preferably, both ends of the torsion beam are fixedly connected to the levers which are pivotally connected to the connectors, which in turn are connected to the rear of the seat frame.

Preferably, at least one connecting element is slidingly mounted on the torsion beam. This allows the position of the mounting points of the elements connecting the torsion beam with the rear axle on the torsion beam to be changed in a smooth way. This causes the change in length of the torsion beam's active section located between the ends of the torsion beam and the mounting points of the elements connecting the torsion beam with the rear axle. This results in smooth adjustment of the seat frame mechanisms, and thus the rigidity of the whole wheelchair frame.

Preferably, at least on connecting element is placed centrally between the ends of the torsion beam.

Preferably, the connecting element is in the form of a clamp.

Preferably, the connector is pivotally connected to the rear of the seat frame.

Preferably, the front part of the seat frame is pivotally connected to the support frame.

Preferably, the connector has multiple openings for connecting the torsion beam lever and/or the seat frame, which allows for stepwise regulation of the seat frame angle relative to the main frame of the wheelchair.

Preferably, the seat frame has multiple openings in its front part which allow its connection to the support frame.

Preferably, the seat frame has multiple openings at the rear which allow its connection to the support frame.

The change of distance between connection points of the front and rear parts of the seat frame with the wheelchair frame allows for changing the depth of the seat on the frame thus affecting the change in the load transferred onto the torsion beam mechanism via the connector.

The solution according to the invention is cheaper to produce and utilize. It ensures easy and safe servicing and use (impossible for the springs to break when the wheelchair is in utilized), thus increasing the user's safety.

The solution according to the invention allows for a swift, easy and smooth regulation of rigidity of the shock absorbing mechanism and, consequently, the rigidity of the wheelchair frame. It is also possible to completely block the mechanism, which causes the wheelchair frame to become completely rigid.

BRIEF DESCRIPTION OF THE DRAWINGS

The subject of the invention has been illustrated in the embodiment on the drawing on which.

DETAILED DESCRIPTION OF THE EMBODIMENT

Figure 1:
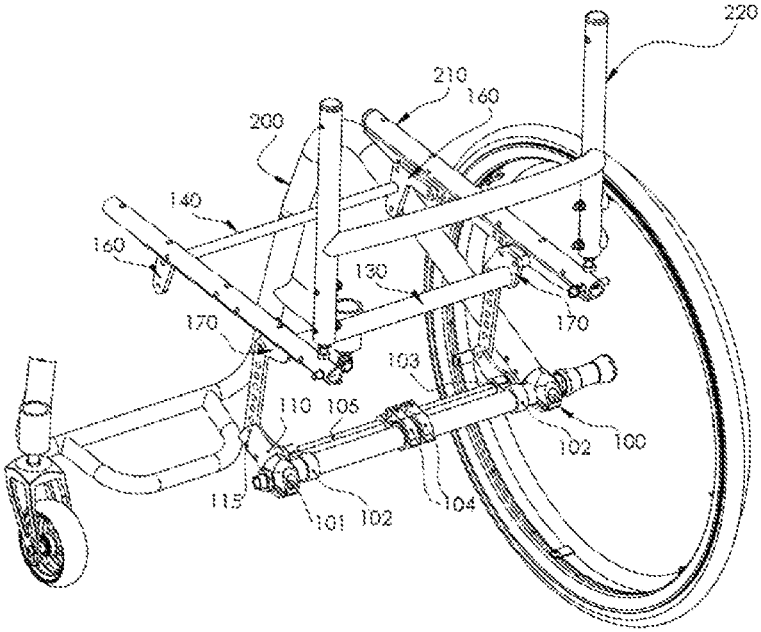
FIG. 1 is a perspective view of the wheelchair with the dismounted wheel and a frame fragment.
Figure 2:
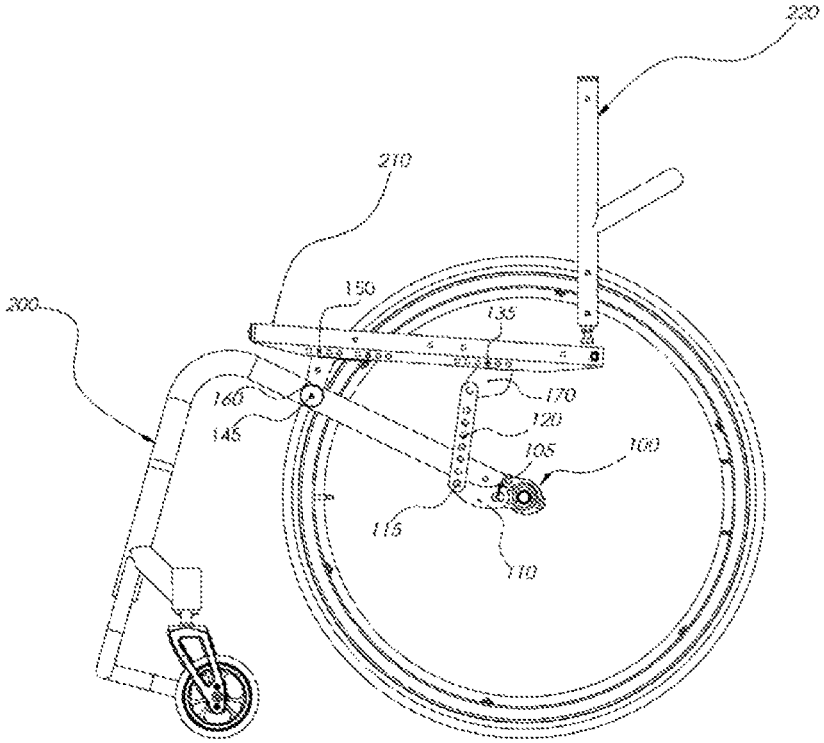
FIG. 2 is a side view of the wheelchair with the dismounted wheel and a frame fragment.
Figure 3:
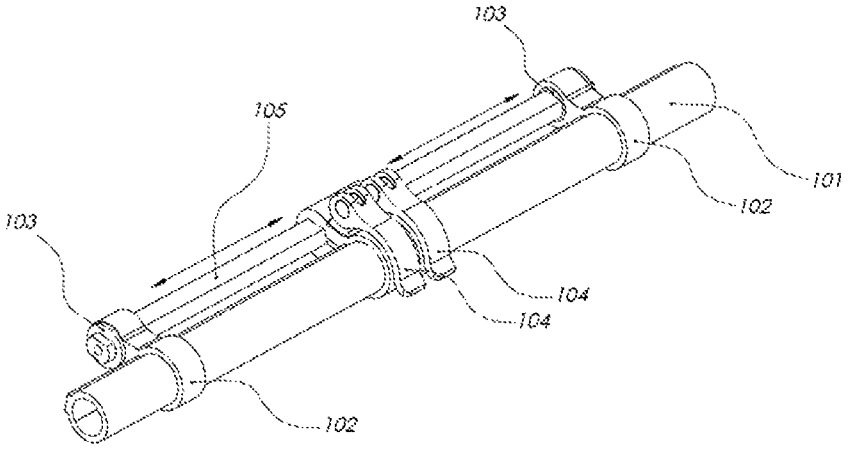
FIG. 3 is a perspective view of the torsion beam connected to the rear axle via connecting elements (clamps) allowing for immobilization of the connection between the torsion beam and the rear axle.

The wheelchair 1 comprises a support frame 200, a seat frame 210, and a rear axle 101 mounted to the support frame 200 with clamps 100. The seat frame 210 including a backrest 220 is connected at points 145 to the support frame 200 using a pair of connectors 160 mounted to a series of openings 150 located in the front part of the seat frame 210, wherein the pair of connectors 160 located on both sides of the seat frame is connected by a stabilizing bar 140. In turn, in the series of openings 135 located in the rear part of the seat frame 210 a pair of connectors 170 is mounted which are connected to each other by a stabilizing bar 130.

The wheelchair 1 further comprises a shock absorbing mechanism in the form of a torsion beam 105 connected to the rear axle 101 of the wheelchair using two connecting elements 104 which allow for immobilization of the connection between the torsion beam 105 and the rear axle 101 in the form of clamps slidingly mounted on the torsion beam 105. This allows the position of the mounting points of the elements connecting the torsion beam with the rear axle on the torsion beam to be changed in a smooth way, which causes the change in length of the torsion beam's active section located between the ends of the torsion beam and the mounting points of the elements connecting the torsion beam with the rear axle which affects the characteristics of the torsion beam's performance and allows control of the wheelchair frame rigidity. The ends of the torsion beam 105 are further pivotally supported by sliding sleeves 103 placed in the 102 brackets mounted on the rear axle 101, which stabilizes the torsion beam 105 and eliminates the bending effect of the torsion beam 105.

Both ends of the torsion beam 105 are fixedly connected to the levers 110, which are pivotally connected to the connectors 120. The connectors 120 are pivotally connected to the seat frame 210 at point 125 via connectors 170. The connectors 120 have multiple openings for connecting the lever 110 of the torsion beam 105 and/or the seat frame 210, which allows for stepwise regulation of seat frame 210 angle relative to the main frame of the wheelchair 200.

The torsion of the torsion beam 105 is done by the wheelchair user applying pressure on the rear part of the seat frame 210, which is transferred via the connector 120 onto the levers 110, which cause the torsion moment of the torsion beam 105. The changes in the pressure force caused by the user during the ride, related to overcoming various types of uneven surfaces, cause the seat frame 210 of the wheelchair 1 together with the user moves relative to the ground and the support frame 200, simultaneously causing the change in the degree of torsion of the torsion beam 105, thus bringing about the shock absorption effect of the seat frame 210, and increasing the comfort of the wheelchair 1 use.

Aligning the connecting elements 104 in the center of the torsion beam 105 results in the maximum symmetrical release of each side of the torsion beam 105, consequently providing the greatest symmetrical shock absorption.

The maximum symmetrical separation of the connecting elements 104 causes blockage of the torsion beam 105 and maximum suspension rigidity of the shock absorbing mechanism.

Any symmetrical intermediate settings of the connecting elements 104, going from the inside to the outside, allow for stiffening the shock absorbing mechanism from the most flexible to the stiffest.

The maximum displacement of both connecting elements 104 towards one of the torsion beam's 105 ends causes blockage of that side of the shock absorbing mechanism on which the clamps 104 are located, while maximally releasing the opposite side.

Any other asymmetrical settings of the connecting elements 104 separately or in pair allow for obtaining various level of rigidity of each side, wherein the closer to the ends of the torsion beam 105 the clamp(s) 104 is/are of the mechanism, the more rigid the given side becomes.

The invention claimed is:

1. A wheelchair comprising a support frame (200), a seat frame (210), wherein the seat frame is connected movingly in a front part to the support frame (200), and is further connected in a rear part to the support frame (200) via a shock absorbing mechanism characterized in that the shock absorbing mechanism is in the form of:

a torsion beam (105) connected to a rear axle (101) of the wheelchair via at least one connecting element (104) which allows for immobilization of connection between the torsion beam (105) and the rear axle (101), wherein at least one end of the torsion beam (105) is fixedly connected to a lever (110), which is connected pivotally to a connector (120) connected to the rear part of the seat frame (210), and wherein the ends of the torsion beam are supported pivotally by slide sleeves (103) located in brackets (102) mounted on the rear axle (101).

2. The wheelchair according to claim 1, characterized in that both ends of the torsion beam (105) are fixedly connected to levers (110) which are connected pivotally to connectors (120) connected to the rear part of the seat frame (210).

3. The wheelchair according to claim 1, characterized in that it comprises two connecting elements (104) which allow for immobilization of the connection between the torsion beam (105) and the rear axle (101).

4. The wheelchair according to claim 3, characterized in that at least one connecting element (104) is slidingly mounted on the torsion beam (105).

5. The wheelchair according to claim 3, characterized in that at least one connecting element (104) is located centrally between the ends of the torsion beam (105).

6. The wheelchair according to claim 3, characterized in that the connecting element (104) is in the form of a clamp.

7. The wheelchair according to claim 1, characterized in that the connector (120) is pivotally connected to the rear part of the seat frame (210).

8. The wheelchair according to claim 7, characterized in that the front part of the seat frame (210) is pivotally connected to the support frame (200).

9. The wheelchair according to claim 1, characterized in that the connector (120) has multiple openings for connecting the lever (110), the torsion beam (105), and/or the seat frame (210).

10. The wheelchair according to claim 1, characterized in that the seat frame (210) in the front part has multiple openings (150) for connecting it to the support frame (200).

11. The wheelchair according to claim 1, characterized in that the seat frame (210) in the rear part has multiple openings (135) for connecting it to the support frame (200).

* * * * *